US005576696A

United States Patent [19]

Adler

[11] Patent Number: 5,576,696

[45] Date of Patent: Nov. 19, 1996

[54] PERSONAL RADIATION HAZARD METER

[75] Inventor: Zdenek Adler, West Hempstead, N.Y.

[73] Assignee: General Microwave Corporation, Amityville, N.Y.

[21] Appl. No.: 109,837

[22] Filed: Aug. 20, 1993

[51] Int. Cl.[6] ..... G08B 17/12

[52] U.S. Cl. ..... 340/600; 324/95; 250/336.1

[58] Field of Search ..... 340/600; 324/95 R, 324/106; 343/702, 841, 718; 250/336.1, 370.07, 338.1, 482.1

[56] References Cited

U.S. PATENT DOCUMENTS

| | | | |
|---|---|---|---|
| 3,927,375 | 12/1975 | Lanoe et al. | 340/600 |
| 3,931,573 | 1/1976 | Hopfer | 324/106 |
| 4,038,660 | 7/1977 | Connolly et al. | 343/18 A |
| 4,301,367 | 11/1981 | Hsu | 250/370 |
| 4,336,532 | 6/1982 | Biehl et al. | 340/600 |
| 4,489,315 | 12/1984 | Falk et al. | 340/600 |
| 4,518,912 | 5/1985 | Aslan | 324/95 |
| 4,851,686 | 7/1989 | Pearson | 340/600 |
| 5,036,311 | 7/1991 | Moran et al. | 340/600 |
| 5,168,265 | 12/1992 | Aslan | 340/600 |
| 5,373,285 | 12/1994 | Aslan | 340/600 |

OTHER PUBLICATIONS

Radar Cross Section—It's Prediction, Measurement and Reduction by Knott et al. pp. 1–2, 247–252, 269, copyright 1985.

American National Standard Safety Levels With Respect to Human Exposure to Radio Frequency Electromagnetic Fields 300 kHz to 100 GHz by The Institute of Electrical & Electronics Engineers, Inc. ANSI C95.1–1982.

*Primary Examiner*—John K. Peng
*Assistant Examiner*—Daniel J. Wu

[57] ABSTRACT

Electromagnetic radiation monitor for use in close proximity with a human body. The monitor includes electromagnetic radiation sensors and shielding disposed behind the sensors which defines a radiation barrier between the monitor user and the sensors. A layer of uniform lossy material is disposed between the sensors and the shield for preventing reflective interference from the shield.

8 Claims, 7 Drawing Sheets

PERSONAL RADIATION HAZARD METER

BACKGROUND OF THE INVENTION

1. Field of the Invention

This invention relates to electromagnetic radiation detection devices. More particularly, this invention relates to electromagnetic radiation detection devices which may be worn by an individual to alert such an individual of harmful levels of electromagnetic energy and which are useful over a broadband of frequencies.

2. Description of Prior Art

The use of high power radio and microwave frequencies in the military, commercial and consumer applications has grown substantially. The applications of high power electromagnetic sources are numerous, including for example, radars, satellite communication ground terminals, radio transmitting antennas and microwave ovens.

One problem with high power electromagnetic radiation is its potential harmful effects on a human body. The American National Standards Institute have established safety guidelines to prevent exposure to harmful levels of electromagnetic radiation.

Harmful levels of electromagnetic radiation may not be detected by an individual until permanent damage results. Accordingly, a work place in the vicinity of high power electromagnetic sources can be a dangerous environment. Therefore, there is a need for a device which can sense electromagnetic radiation and provide an alert signal indicating harmful ambient levels. Furthermore, because of the numerous applications of electromagnetic sources and the multitude of frequencies generated, such electromagnetic radiation detection devices having a broadband frequency performance are desirable.

Broadband electromagnetic radiation detection devices have been used in the art for many years. For example, U.S. Pat. No. 3,931,573 assigned to the assignee of the present invention, discloses a hand-held radiation detector. However, hand-held radiation detectors may sometimes be cumbersome and inconvenient. Therefore, radiation hazard meters which can be worn by an individual are both practical and desirable.

When constructing a personal radiation hazard meter, electromagnetic interference from a human body is a concern. It is known that interference in the form of electromagnetic scattering results when electromagnetic radiation reflects off a human body. Such scattered reflections interfere with the electromagnetic radiation being detected by the radiation detector.

To minimize body interference, the radiation sensors of personal radiation hazard meters require shielding of the electromagnetic radiation sensor from the user's body. The shield, however, may produce its own source of interference due to unwanted reflections.

The use of lossy material as a radiation absorber to absorb reflective radiation is well known in the art. However, even lossy material has a measurable reflective characteristic. Generally, the more highly absorbent the lossy material is the more reflective it is. This property of lossy material suggests that the use of multiple layers of lossy material having different absorbent (and, accordingly, reflective) characteristics would be most effective in eliminating reflective interference with the radiation sensors from the conductive shield.

In such case, less absorbent/reflective lossy material is disposed behind the radiation sensor, then at least a second layer of more absorbent/reflective lossy material is disposed behind the first layer and in front of the shield. An example of this technique is shown in U.S. Pat. No. 5,168,265 (Aslan).

Applicant discovered that a single uniform layer of lossy material provided superior results in eliminating reflective interference. Unlike the "backing" of "graduated" lossy material disclosed in U.S. Pat. No. 5,168,265, a uniform layer of lossy material disposed a selected spaced distance behind the sensor is used in conjunction with the radiation sensor of the meter of the present invention.

SUMMARY AND OBJECTS OF THE INVENTION

A radiation meter is provided having the back of its radiation sensors shielded to enable the meter to be worn on the human body without body interference. A uniform layer of lossy material is disposed between the shield and the sensors which effectively eliminates reflective interference from the shield.

The object of this invention is to provide an improved personal radiation hazard meter which has broadband frequency performance characteristics.

It is another objective of this invention to provide an improved personal radiation hazard meter which minimizes the effects of electromagnetic radiation interference caused by a human body.

It is also an object of this invention to provide an improved personal radiation hazard meter which displays the power density of the electromagnetic radiation being sensed and alarms the user whenever the radiation exceeds a predetermined level.

It is another object of this invention to provide an improved personal radiation hazard meter which may be used with an earphone to allow the user to work in high noise environments.

BRIEF DESCRIPTION OF THE DRAWINGS

The foregoing and other objects of this invention will be apparent from the following detailed description when read together with the following description, in which.

DESCRIPTION OF THE PREFERRED EMBODIMENT

Figure 1:
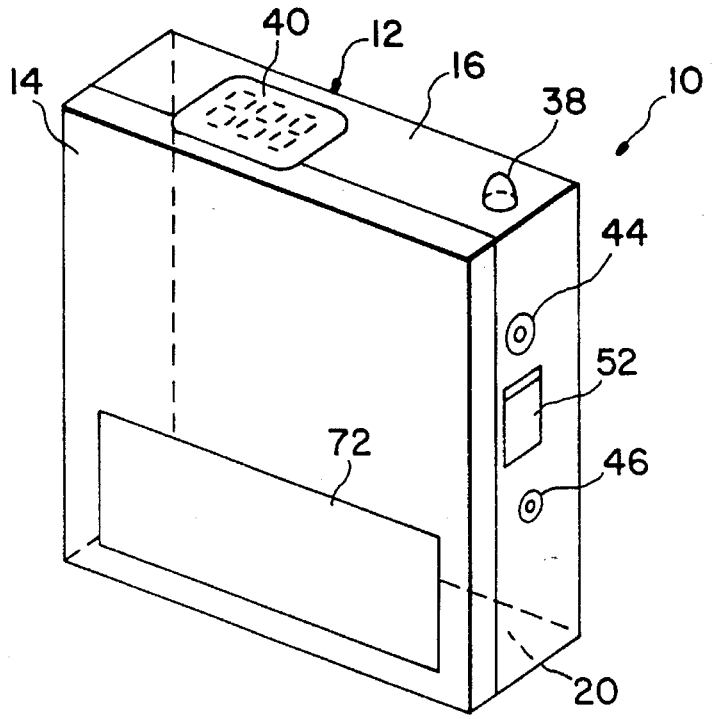
FIG. 1 is a front perspective view of a personal radiation hazard meter made in accordance with the present invention.
Figure 2:
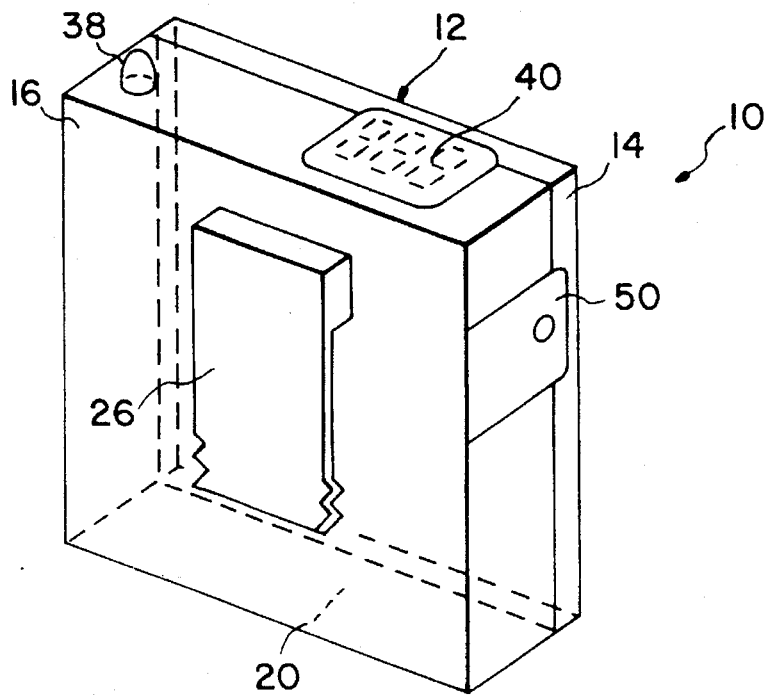
FIG. 2 is a back perspective view of the radiation hazard meter shown in FIG. 1.
Figure 3:
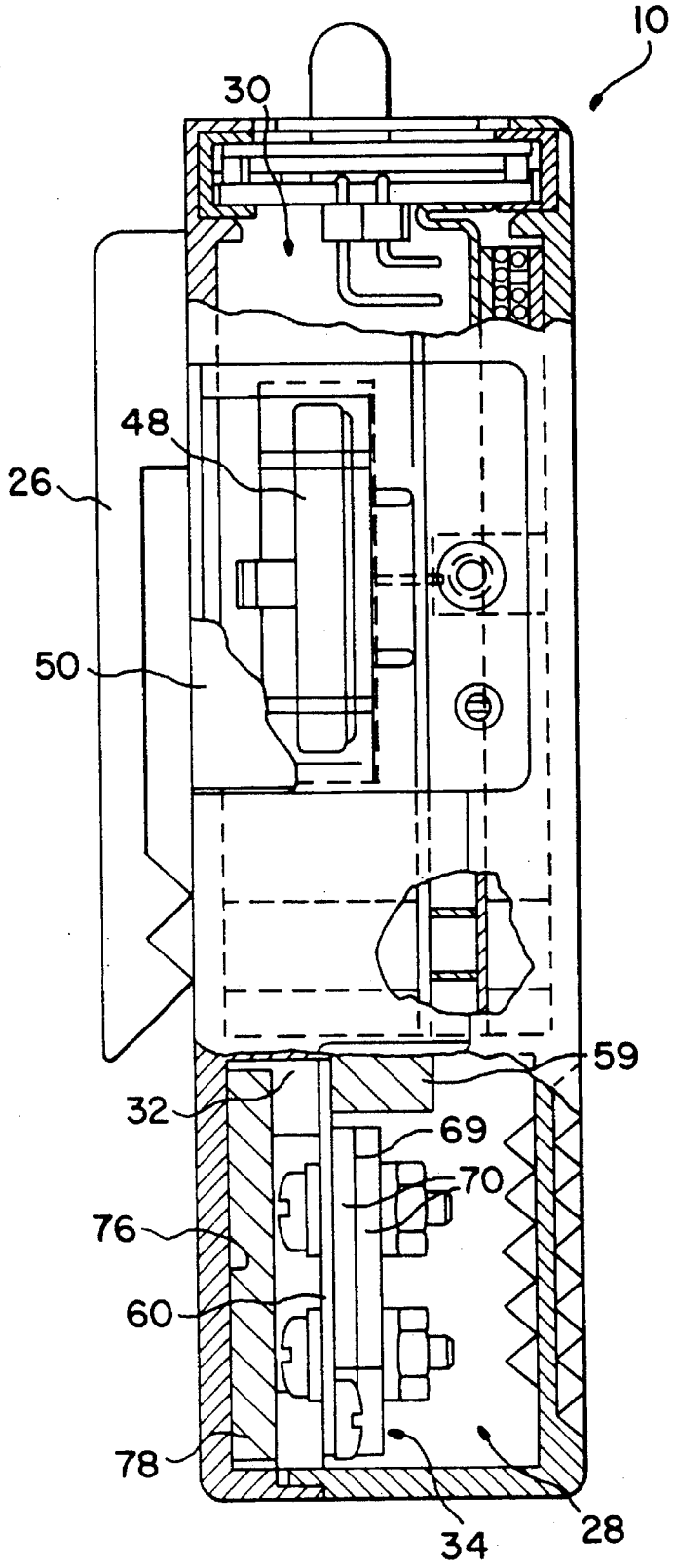
FIG. 3 is a left side cross-sectional view of the radiation hazard meter shown in FIG. 1.

With reference to FIGS. 1–6, there is shown an radiation hazard meter 10 which is to be used in close proximity to a human body. The meter 10 has a two-piece housing 12 comprised of a front cover 14 and a containment 16. The back of the monitor includes a clip 26, so that the monitor can be clipped to a user's belt or clothing. The interior of the housing 12 is partitioned into lower and upper chambers 28, 30 by an interior wall 32. The lower chamber 28 houses an antenna assembly 34 which functions as the radiation sensor. The upper chamber 30 houses the electronic processing circuitry 36 which is electrically coupled to sensor 34. The electronic processing circuitry 36 analyzes the radiation levels detected by the antenna assembly 34. For example, see U.S. Pat. No. 3,931,573, and the references cited therein which patents are incorporated herein by reference as if fully set forth.

The electronic processing circuitry 36 is operatively associated with a light emitting diode (LED) 38, a liquid crystal display 40, and a speaker 42 associated with an earphone receptacle 44. The LED 38 continuously flashes to alarm the user when the radiation sensor 34 detects electromagnetic radiation which exceeds a pre-determined level. The radiation hazard meter 10 also warns the user by sending an audible signal through the earphone receptacle 44 to the user via an earphone 45. In addition, the LCD indicator 40 also flashes when the radiation sensor 34 detects electromagnetic radiation above a pre-determined energy level.

In the preferred embodiment, the electronic processing circuitry 36 is configured to permit multiple modes of measurement and has level settings ranging from 0.02 to $20mW/cm^2$. A measurement mode switch 46 enables the user to change the measurement mode indicated on the LCD indicator 40 and select from available modes. The LCD indicator 40 either displays the instantaneous power density in milliwatts per centimeters squared or the six minute average power density in milliwatts per centimeters squared, depending on the measurement mode.

The electronic processing circuitry 36 is powered by one or more lithium batteries 48 which are installed into the upper compartment via a battery hatch 50. An on/off switch 52 controls the power supplied from the batteries 48 to the electronics 36.

In order to prevent undue interference with the performance of the electronic processing circuitry 36, shielding is provided. In particular, a combination of layered absorbent material and metallic shield are disposed in front of and below the electronic processing circuitry 36. The circuitry shielding is comprised of a first layer of a relatively low absorbent lossy material 54, a layer of relatively high absorbent lossy material 56 and a thin layer of foil or conductive paint 58 behind the relatively high absorbent lossy material 56. The relatively low absorbent layer of lossy material 54 is manufactured by Emerson and Cuming and designated Eccosorb® LS-16. The relatively high absorbent layer of lossy material 56 is also manufactured by Emerson and Cuming and is designated as Eccosorb® FGM-40. The properties of the lossy materials are set forth in Emerson and Cuming's Technical Bulletins 8-2-23 dated January, 1985 and 2-11 dated November, 1980 which are herein incorporated by reference as if fully set forth.

Figure 4:
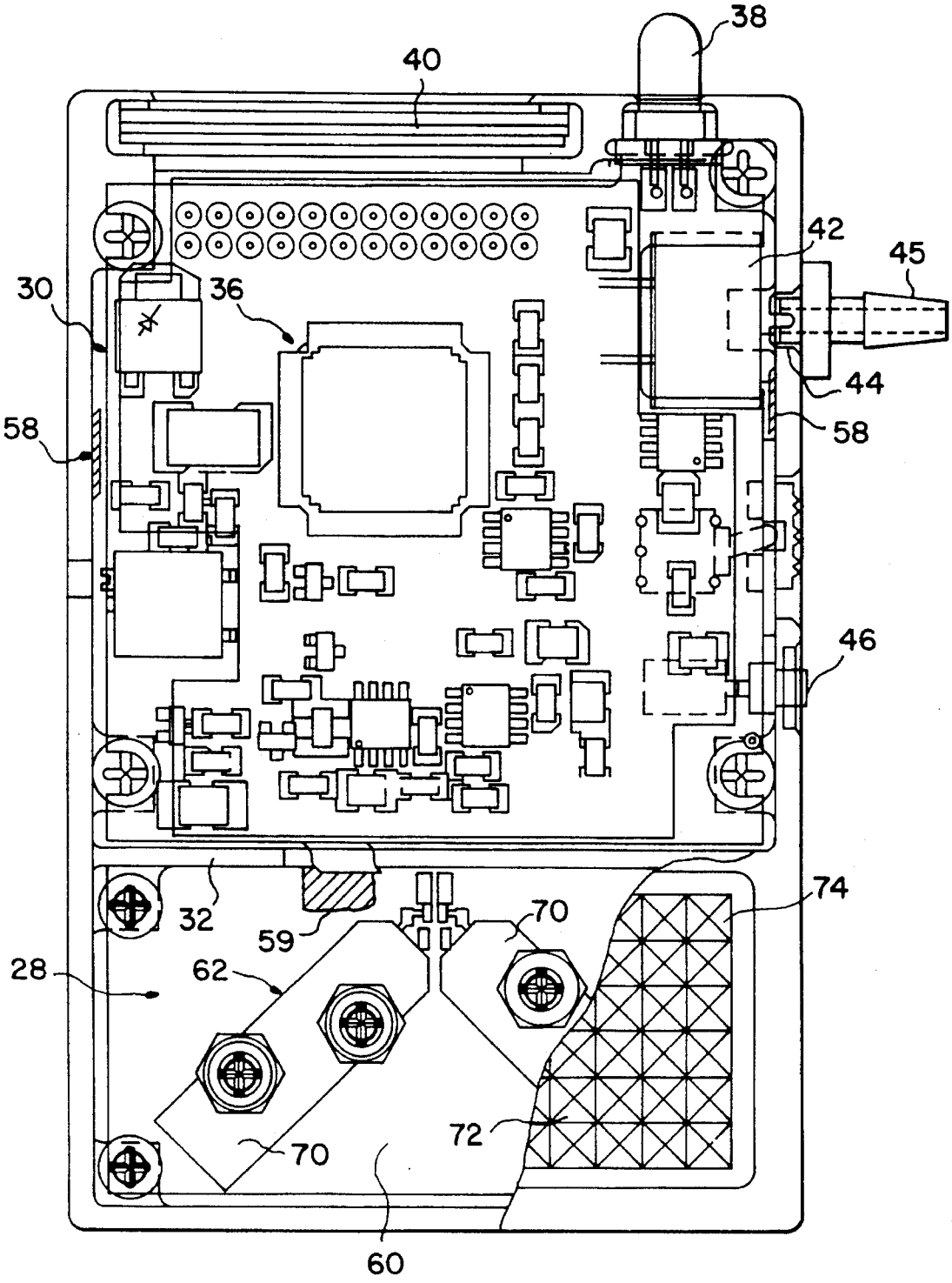
FIG. 4 is a front open-cover view of the radiation hazard meter shown in FIG. 1.
Figure 5:
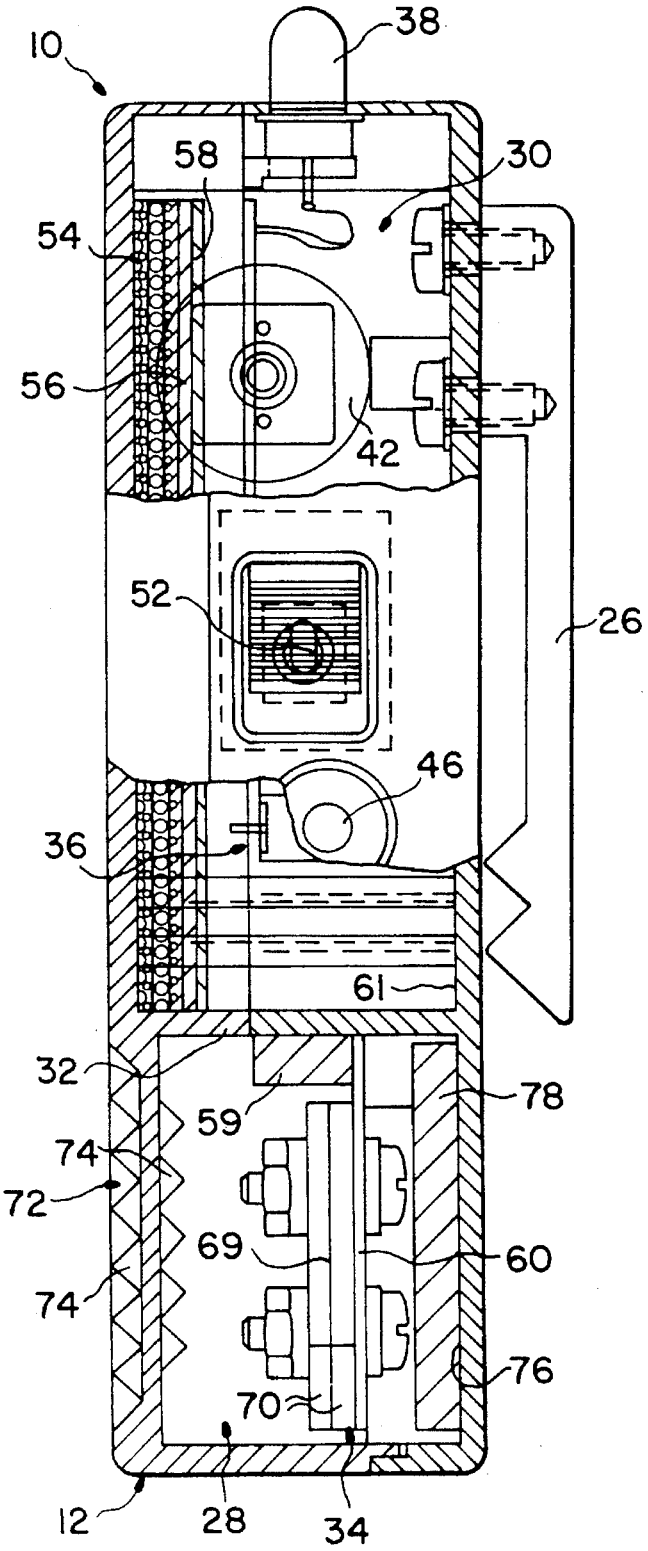
FIG. 5 is a right side cross-sectional view of the radiation hazard meter shown in FIG. 1.

Additional shielding in the form of conductive paint or foil 58 is provided for the sides, partially shown for clarity in FIG. 4, of the electronic processing circuitry 36. Further protection is provided below the electronic processing circuitry 36 by absorber 59 mounted on the upper wall of the lower chamber 28. Absorber 59 is a uniform layer of lossy material such as Eccosorb® FGM-40 or LS-26 manufactured by Emerson and Cuming. The interior of the upper portion of the containment 16 is provided with a coating of metallic paint 61 which provides shielding in back of the processing circuitry 36.

Figure 6:
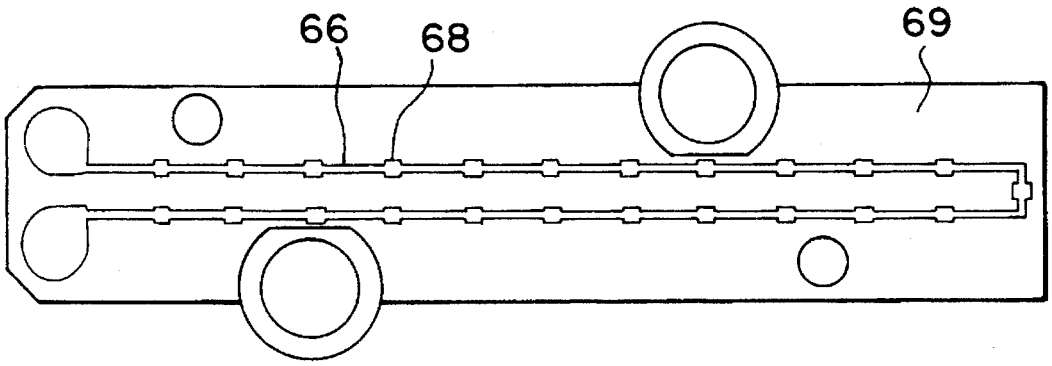
FIG. 6 is a front elevational view of an antenna element of the radiation hazard meter shown in FIG. 1.

The antenna assembly 34 comprises a dielectric panel 60. Mounted on the front of the dielectric panel 60 are two mutually orthogonal antenna assemblies 62 which are coplanar with each other. Each antenna assembly 62 includes an array of thin film thermocouples 66, 68 formed on a substrate 69, as shown in FIG. 6. Each thermocouple is composed of two dissimilar metals 66 and 68, overlapping and connected in series as set forth in U.S. Pat. No. 3,931,573.

Each thermocouple supporting substrate 69 is sandwiched between a pair of dielectric covers 70 which are mounted on the panel 60. The antenna assembly 34 absorbs a portion of the radiation and, operating thermoelectrically, converts the electromagnetic radiation being absorbed into a DC voltage for further processing.

A radiation window 72 is defined in the front of the sensor chamber 28 in the housing. The window 72 is defined by a square array of pyramidal shapes 74 molded on both sides of the housing cover 14. At high frequencies, this construction tends to have a scattering effect on any reflected signal to inhibit reflections back onto the antenna.

Since the radiation monitor is designed to be worn on a person's body, shielding is desirable behind the antenna assembly to prevent interference attributable to the user's body. Such shielding is provided in the form of a layer of conductive paint and/or foil 76 disposed on the back wall of the sensor chamber 28. No shielding is provided on the bottom or sides of the sensor chamber 28 since the effect of body interference of the radiating sensor 34 from those angles is negligible.

Although the metallic shielding 76 serves to shield the antenna assembly from interference from the user's body, it also causes radiation to be reflected back towards the antenna assembly 34. Such reflective radiation detrimentally affects the accuracy of the hazard meter.

An initial attempt to solve the problem of reflective radiation was made by mounting two layers of lossy material behind the antenna assembly and in front of the metallic shielding 76. The first layer of lossy material being Eccosorb® LS-16 having a lower absorbent/lower reflective characteristic; the second layer of lossy material, disposed between the first layer and the shield, being Eccosorb® FGM-125 having a higher absorbent/higher reflective lossy material.

Through experimentation and testing, it was discovered that single layer of uniformly absorbent lossy material 78 provided the best overall results in protecting the sensor 34 from reflective interference from the metallic shielding 76. Accordingly, in the preferred embodiment, a layer of uniform lossy material 78 being 3.2 mm thick and made of Eccosorb® FGM-125 is mounted directly on the metallic shielding 76. The antenna thermocouple sensors 66, 68 are disposed approximately 5.7 mm in front of the front surface of the uniform layer of lossy material 78 of which approximately 3.2 mm is an air gap between the mounting panel 60 and the lossy material 78.

Figure 7:
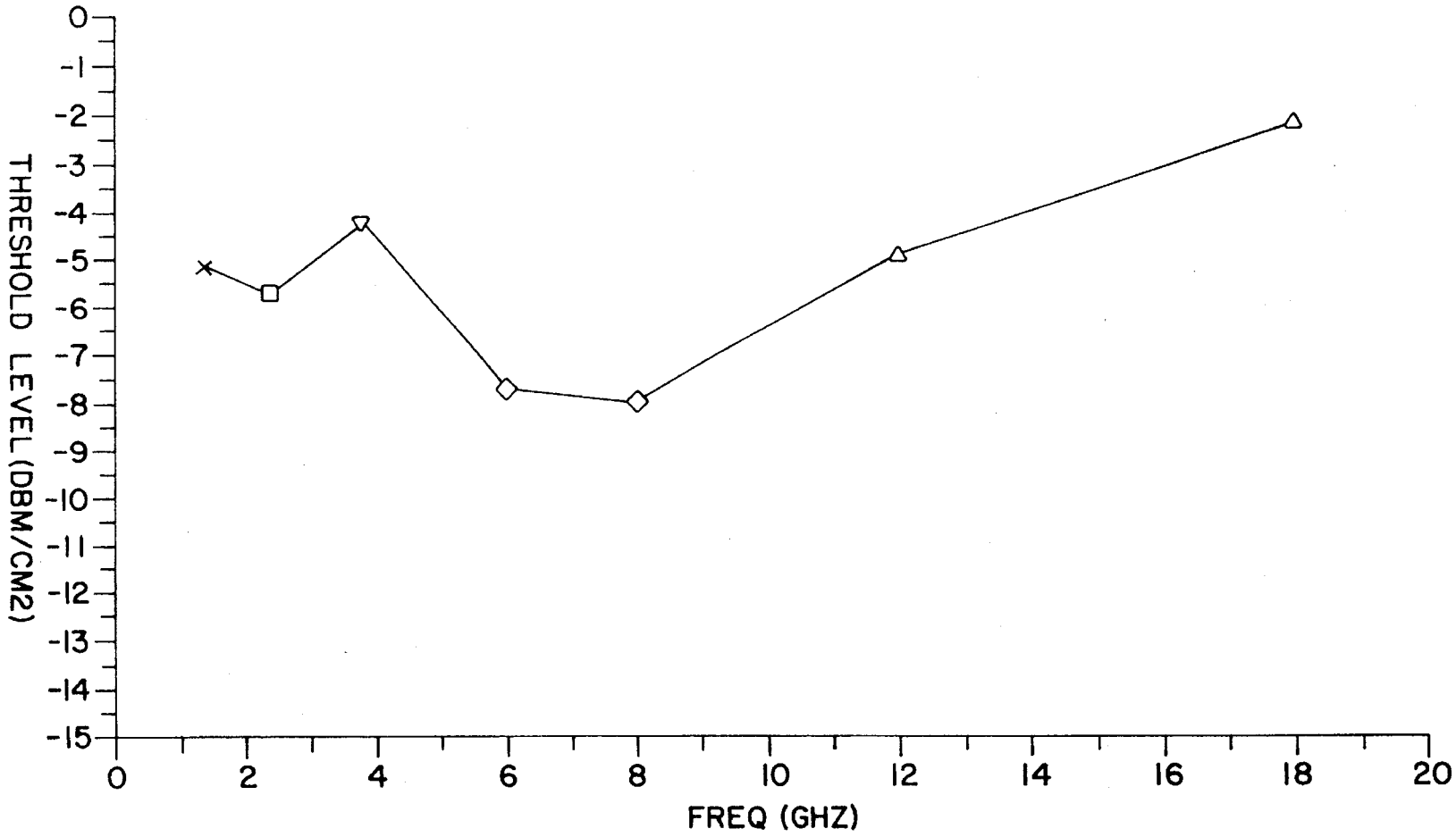
FIG. 7 is a graph showing the frequency response of an experimental radiation hazard meter.
Figure 8:
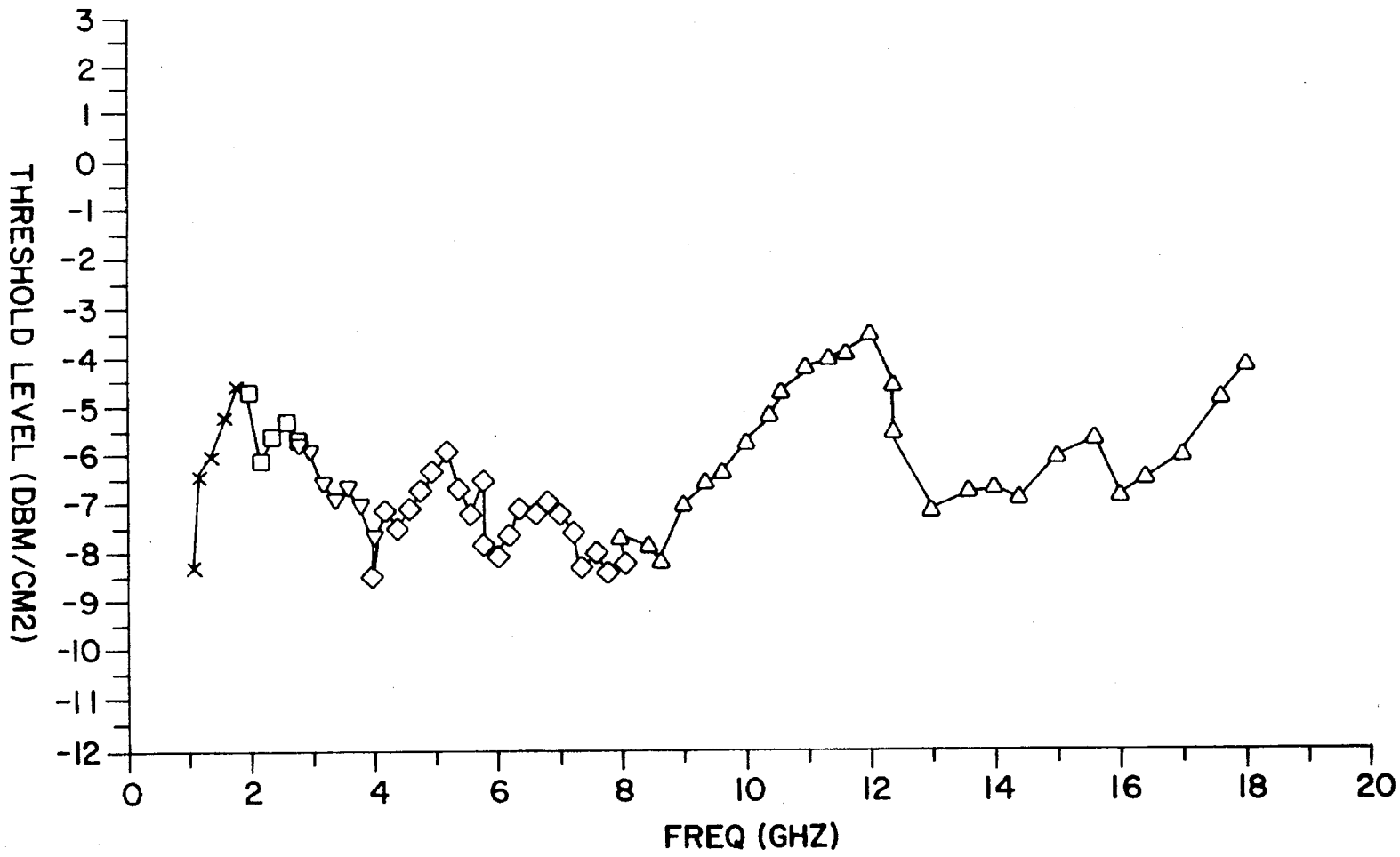
FIG. 8 is a graph showing the frequency response of the radiation hazard meter shown in FIG. 1.

FIG. 7 illustrates the frequency response of the initial attempt utilizing two layers of lossy material in the radiation hazard monitor. As seen from the graph, minimum and maximum responses varied about 5.8 dB across a frequency band of 1 GHz to 18 GHz. In comparison, FIG. 8 shows the frequency response of the preferred embodiment. As seen from the graph, the radiation hazard meter 10 exhibited a relatively flat 4.2 dB variance in response across a frequency band of 1 GHz to 18 GHz. This is an improvement of 1.6 dB in flatness of response as compared to the initial attempt.

In operation, the radiation sensor 34 absorbs a portion of the electromagnetic radiation which enters the sensing chamber 28 and generates a DC voltage that is proportional to the energy of the electromagnetic radiation. The electromagnetic radiation that travels past the radiation sensor 34 propagates through and is partially absorbed by the lossy material 78. Any radiation which is not absorbed by the lossy material 78 reflects off the shield 76. The reflected electromagnetic radiation again travels through the lossy material 78 and propagates towards the radiation sensor 34. The round-trip propagation through the lossy material 78 substantially reduces the energy of the escaped electromagnetic radiation. Although some of the radiation reflects directly off the front of the lossy material 78, the result is the virtual elimination of electromagnetic radiation scattering which may cause interference with the radiation being sensed by the radiation sensor 34.

What is claimed is:

1. An electromagnetic radiation monitor for use in close proximity with a human body comprising:

an electromagnetic radiation sensor means having front and back sides;

shield means mounted in back of the radiation sensor means a selected distance such that when the radiation monitor is used in close proximity with a human body, the shield means defines a radiation barrier between the human body and the entire back side of the sensor means; and means for preventing reflective interference from said shield means with said sensor means consisting essentially of a single layer of uniform lossy material mounted a selected spaced distance behind said sensor means in front of said shield means.

2. An electromagnetic radiation monitor as defined in claim 1, which further includes a dielectric mounted in front of said sensor means.

3. An electromagnetic radiation monitor as defined in claim 1, wherein the electromagnetic radiation sensor means comprises a plurality of orthogonal and coplanar arrays of thin film thermocouples.

4. An electromagnetic radiation monitor as defined in claim 3, wherein the arrays of thin-film thermocouples are formed on a dielectric substrate.

5. An electromagnetic radiation monitor as defined in claim 1, wherein said shield means comprises a portion of a back wall of a monitor housing which is coated with a conductive paint.

6. An electromagnetic radiation monitor as defined in claim 1, which further includes an electronic circuit coupled to the radiation sensor for generating a signal in response to radiation detected by said sensor.

7. An electromagnetic radiation monitor comprising:

an electromagnetic radiation sensor;

a conductive shield associated with said sensor; and a means for preventing reflective interference from said shield with said sensor consisting essentially of a single layer of uniform lossy material interposed between the sensor and the shield, said layer of lossy material having a front face and a back face, the back face attached to the shield, the front face selectively spaced apart from the sensor.

8. An electromagnetic radiation monitor as defined in claim 7, wherein the electromagnetic radiation sensor comprises a plurality of orthogonal and coplanar arrays of thermocouples.

* * * * *